United States Patent [19]

Mikuteit

[11] Patent Number: 4,558,966

[45] Date of Patent: Dec. 17, 1985

[54] WRITING INSTRUMENT WITH SEALING CAP

[75] Inventor: Axel Mikuteit, Hamburg, Fed. Rep. of Germany

[73] Assignee: Koh-I-Noor Rapidograph, Inc., Bloomsbury, N.J.

[21] Appl. No.: 530,819

[22] Filed: Sep. 9, 1983

[30] Foreign Application Priority Data

Sep. 17, 1982 [DE] Fed. Rep. of Germany ..... 3234514

[51] Int. Cl.[4] ..... B43K 9/00

[52] U.S. Cl. ..... 401/213; 401/202; 401/243; 401/244; 401/247; 401/258; 401/262; 401/251; 220/302

[58] Field of Search ..... 401/202, 213, 243, 244, 401/246, 247, 262, 251; 220/302

[56] References Cited

U.S. PATENT DOCUMENTS

| | | | |
|---|---|---|---|
| 1,239,971 | 9/1917 | Ruff . | |
| 1,838,543 | 12/1931 | Goldstein . | |
| 2,192,644 | 3/1940 | La May et al. . | |
| 2,396,771 | 3/1946 | Brinson, Sr. . | |
| 2,436,763 | 2/1948 | Wing | 120/42 |
| 2,453,491 | 11/1948 | Cardin . | |
| 3,184,782 | 5/1965 | Armour | 401/262 |
| 3,252,446 | 5/1966 | Bateman | 401/202 |
| 3,547,552 | 12/1970 | Rosler . | |
| 3,802,788 | 4/1974 | Danjczek et al. . | |
| 4,341,481 | 7/1982 | Wollensak | 401/251 |
| 4,355,726 | 10/1982 | Mutschler | 401/202 X |
| 4,380,403 | 4/1983 | Endres et al. . | |

FOREIGN PATENT DOCUMENTS

| | | | |
|---|---|---|---|
| 945818 | 7/1956 | Fed. Rep. of Germany . | |
| 992128 | 10/1951 | France | 401/244 |
| 631195 | 10/1949 | United Kingdom | 401/244 |

*Primary Examiner*—Steven A. Bratlie

*Attorney, Agent, or Firm*—David H. Semmes; Warren E. Olsen

[57] ABSTRACT

A writing instrument having a closure cap assembly (1, 2, 3, 4 and 5) which can be placed in a sealing manner on the writing tip (20), whereby a positive engagement with an indentation in the writing tip is established via an elastically deformable finger (8), when the closure cap is in place on the writing tip. On the inner face of the arm (8), oriented toward the writing tip (20), at least one cam face (13) is located in a chord plane of the circle forming the closure cap opening. Whereupon a twisting of the entire mounted closure cap assembly (1, 2, 3, 4 and 5) brings the cam face (13) into engagement with a correspondingly formed wedge face (27) of the writing tip (20), so that the arm (8) is pivoted radially outward, and the closure cap can be removed.

9 Claims, 7 Drawing Figures

WRITING INSTRUMENT WITH SEALING CAP

BACKGROUND OF THE INVENTION

1. Field of the Invention

The invention relates to a writing instrument with a removable closure cap which sealingly closes its writing tip. On the insertion side, the cap has at least one elastically deformable finger extending substantially axially. When the closure cap is in place on the writing instrument, this finger engages an indentation upon the shaft of the writing tip, and an annular shoulder of the writing tip located in the closure cap is in sealing engagement with a sealing shoulder of the closure cap.

2. Brief Description of the Prior Art

In a known writing instrument of this type (German Pat. No. 945 818), a plurality of arms in the form of leaf springs are present in the closure cap, and these leaf springs are curved on their ends nearer the insertion side of the closure cap. This curved end area, when the closure cap is in place on the writing instrument, will grip an annular shoulder of the writing tip from behind. In order to release the closure cap, a special unlocking device is present. By means, and with the aid, of an axially displaceable button, releasing rails are pushed in between the leaf springs and the writing tip, thereby disengaging these elements from one another. Only after this disengagement has been effected can the closure cap be pulled off from the writing tip.

An unlocking device of this kind is not only expensive to fabricate but is also susceptable to failure, because it has parts that are movable counter to spring force.

OBJECT AND SUMMARY OF THE INVENTION

It is accordingly the principal object of the invention to create a writing instrument in which the closure cap placed on the writing tip is seated firmly when it is in this mounted state and thus produces a good sealing effect, and in which the closure cap can be removed without having to use an unlocking device that has moving parts.

In order to attain this object, a writing instrument of the type described at the outset above is embodied in accordance with the invention such that at least one cam face, substantially located in a chord plane of the circle forming the opening of the closure cap, is provided on the face of the finger oriented toward the indentation when the closure cap is in place on the writing instrument. By twisting the mounted closure cap, this cam face can be brought into engagement with a correspondingly shaped wedge face on the shaft or on the writing tip. At least two cam faces inclined in opposite directions are preferably provided on the finger. In the vicinity of their intersection, the cam faces are spaced apart from the longitudinal axis of the closure cap by the least possible distance radially, as shown by the finger in its unstressed position, at FIG. 3.1 and FIG. 3*a*. The intersection moves radially away from its centerline when deformed by a progressive twisting, as shown in FIGS. 3*b*, 3*c*. The two cam faces are guidable between corresponding wedge faces, also inclined in opposite directions.

The plug connection existing between the closure cap and the writing tip in the writing instrument embodied according to the invention can thus be disconnected with the aid of the engagement of an inclined cam face with a correspondingly inclined wedge face. This is due to an engagement and a twisting of the mounted closure cap relative to the writing tip which causes the elastically deformable finger of the closure cap to be pivoted radially outward, and release the protrusion having the cam face from the indention in the shaft or in the body of the writing instrument. The closure cap can accordingly then be removed from the writing tip.

If two cam faces inclined in opposite directions, and associated wedge faces, are provided (as in the preferred embodiment), then the closure cap can be released by twisting it in any desired direction relative to the writing tip.

In order to require the least possible twisting to release the closure cap, wedge faces inclined in opposite directions and distributed over the entire circumference of the shaft or of the writing tip may be provided. Hence, even a relatively little twisting, will engage the cam face with the wedge face, and thereby pivot the arm radially outward, and enable release of the closure cap.

The wedge faces inclined in opposite directions can be connected with one another at their end areas nearer the front end of the writing tip, leaving the tips of the wedge faces free. Thereby, the indentation for engagement of the finger is located behind this connection, and the engagement is effected by means of a protrusion which has cam faces. Since the tips of the wedge faces protrude beyond the connecting areas, a corresponding twisting will effect a raising of the cam faces out beyond the wedge faces, thereby enabling the closure cap to be moved, without resistance.

In order to attain an automatic alignment of cam faces and wedge faces when the closure cap is placed upon the writing tip, the areas of the cam faces oriented toward the insertion side of the closure cap may be inclined relative to the longitudinal axis, and such that they rise radially toward the inside from the insertion side toward the inner end, or the areas of the wedge faces oriented toward the front end of the writing tip may be inclined relative to the longitudinal axis, so that they rise radially toward the outside, from the front end toward the lower end. As a result of this inclination, the arm is pressed radially outward in every position when the closure cap is being put into place, and thus this arm moves into the vicinity of the wedge faces. In this vicinity, then, by means of the engagement of the wedge faces with the cam faces, a corresponding twisting of the closure cap relative to the writing tip is effected automatically, so that the desired engagement is attained.

It should be noted that within the context of the invention, the term "closure cap" is understood to include both a conventional push-on cap and a tubular holder element such as is used in a stand for writing instruments.

The invention will now be described in detail, referring to the drawings, which illustrate one exemplary embodiment.

BRIEF DESCRIPTION OF THE DRAWINGS

FIGS. 3.1 and 3.2 are transverse section views of the closure sheath and the shaft of the writing tip, respectively, taken along line III—III of FIG. 2.

DESCRIPTION OF THE PREFERRED EMBODIMENT

Figure 1:
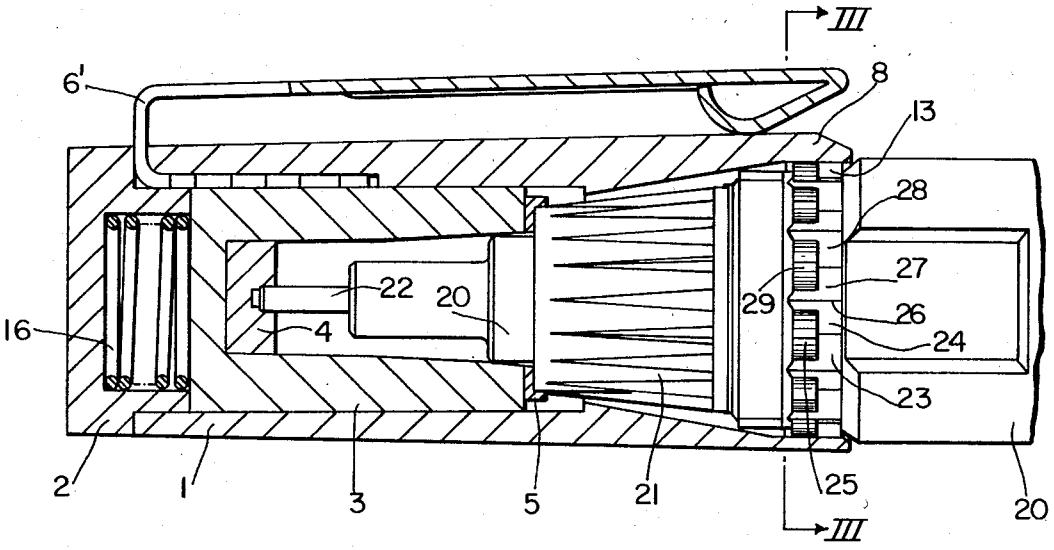
FIG. 1 is a section taken through the front part of a writing tip, with the closure cap in place thereon.

The writing instrument partially shown in FIG. 1 comprises a tubular-tipped writing instrument having a writing tip 20, in the front end of which a writing tubule 22 is held. A conventional ink-compensation chamber (not shown), is covered by a plastic housing 21, which is removable at the front in the direction of the writing tubule 22, in order to uncover the ink-compensation chamber so that it can be cleaned.

Wedge faces are disposed around the circumference of the writing tip 20 in the area behind the ink-compensation chamber and thus behind the housing 21. Only exemplary wedge faces 23, 24, 27, 28 are individually identified in FIG. 1, but are further shown in FIG. 3.2. These wedge faces are planar in the preferred embodiment. The wedge face 27 rises, when viewed from the end of the writing tubule 22, in a clockwise direction; that is, its distance from the central axis of the writing tip 20 increases gradually, until the edge 26 is attained, at which edge the wedge face 27 ends and the wedge face 24 begins. The wedge face 24 then begins at the edge 26, with an opposite inclination equal to the wedge face 27, and decreases its distance from the central axis of the writing tip 20 in a clockwise direction (as viewed from the writing tubule 22, end) until the beginning of the wedge face 23 is attained. The wedge face 23 then rises in turn, and corresponds to the wedge face 27. It must be noted that all the wedge faces have the same shape and dimensions. The end areas of the wedge faces toward the left in FIG. 1 (those end areas located closer to the writing tubule 22), are connected with one another by rounded webs 25 and 29. The web 25 connects the wedge faces 23 and 24, and the web 29 connects the wedge faces 27 and 28. The remaining wedge faces are connected with one another in the same manner by webs which are not individually identified, but are illustrated in FIGS. 1 and 3.2. The height of the webs is less than the outer tips of the wedge faces, such as tip 26, as defined between two adjacent wedge faces.

In the preferred embodiment, the wedge faces and the webs are molded integrally with the barrel or shaft of the writing tip 20.

Figure 2:
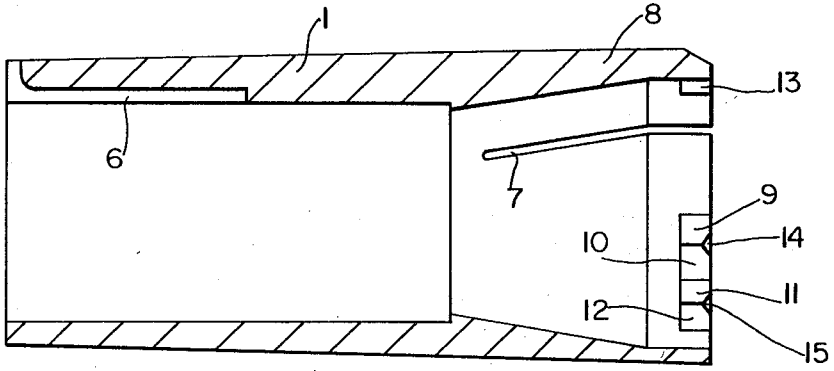
FIG. 2 is a section taken through the sheath of the closure cap, this sheath including the arm and the cam faces.

The closure cap comprises a sheath 1 as illustrated in FIGS. 2 and 3.1, and is made of plastic with its left end, in FIG. 2, having a groove 6 for receiving the fastening end of a clip 6'. The clip is held in its position by a slideable, cup-like insert 3 and an insertion knob 2. In the vicinity of the bottom of the slideable insert 3, there is an elastic seal 4, and a second, elastic ring seal 5 is provided on the end face of the insert 3 located toward the right in FIG. 1. The ring seal 5 seals off the annular space between the writing tip 20 and the sheath 21 when the writing tip 20 is in the inserted position, while the front end of the writing tubule 22 is sealed by the 4. The spring 16 provided between the insertion knob 2 and the slideable insert 3 presses insert 3, and thus the seal 4 and the ring seal 5, against the writing tip 20.

An elastically deformable arm 8 is formed in the sheath 1 by means of two axially extending notches. The notch 7 is visible in FIG. 2, while the second notch extends at the same height as the notch 7 in FIG. 2 and has the same depth as well and is shown in FIG. 3.1. Cam faces also are embodied on the free end of the arm 8 and on the remaining wall of the sheath 1 in the vicinity of the insertion opening, i.e., at the level of the free end of the arm 8. These cam faces are planar and extend at the same inclination as do the wedge faces of the writing tip. For instance, the cam face 9 rises, as viewed from the left end of the sheath 1 in FIG. 1, in the clockwise direction and its distance from the central axis of the sheath 1 decreases until the beginning of the cam face 10 is attained, while the cam face 10, at the same inclination, increases its distance from the central axis of the sheath 1, all as shown more clearly in FIG. 3.1. In corresponding fashion, the cam face 11 at the transition from the cam face 10 to the cam face 12 decreases its distance from the central axis of the sheath 1, and the cam face 12 takes the same course as does cam face 10. The cam face 13 visible on the arm 8 is one of two opposed cam faces embodied on this arm (as shown in FIG. 3.1). Cam face 13 extends on the sheath 1 toward the back, out of the plane of FIG. 2, and thereby decreases its distance from the central axis of the sheath 1, while the facing cam face shown in FIG. 3.1 extends at a corresponding inclination out of the sectional plane of FIG. 2 and towards the front, and decreases its distance from the central axis of the sheath 1. The two cam faces, therefore, are located in chord planes of the same circle which defines the cylindrical opening area of the sheath 1, as can be appreciated from the view of FIGS. 3.1 and 3*a*.

As already mentioned, there are two cam faces on the arm 8, of which only the cam face 13 is visible in FIG. 2. Around the remaining inner circumference of the sheath 1, proximate the opening end, a second group of cam faces 9, 10, 11, 12 is provided. As shown in FIG. 3.1 a corresponding third group of cam faces also may be provided, offset by 120 degrees, from the second group, and also proximate the opening area of the sheath 1.

As shown in FIG. 2, the cam faces on the opening side of the sheath 1 are beveled, so that surface regions 14 and 15 are formed, which extend axially and radially inward from the opening side. When the closure cap axially is placed upon the writing tip 20, these oblique cam faces 14, 15 (and a corresponding oblique face on the arm 8, not shown) come into engagement with the pen body either through the ends of the wedge faces, protruding toward the left in FIG. 1, or through the webs 25 and 29. In each case, the oblique cam faces accordingly slide over and contact wedge faces on the writing tip body 20, and the arm is pivoted radially outward. As a result, the cam faces 9, 10, 11, 12, 13 are capable of sliding along the webs 25, 29 until they reach the vicinity of the wedge faces 23, 24, 27, 28, which in FIG. 1 are located to the right of the webs 25 and 29. In this position, the oblique cam faces come into engagement with the wedge faces, and the cap is rotated by the combined pressure exerted by the elastic arm 8 and a sliding movement. This sliding movement is produced when the cam faces move over the wedge faces in such a manner that the wedge faces each have a large surface area in contact with the cam face located in their vicinity, as shown in FIG. 3*a*. In this position, the closure cap can no longer be removed from the writing tip 20, because the cam faces, or the protrusions forming the cam faces, grip the webs between the wedge faces of the writing tip 20, from behind, or the right side of the exemplary web 25, as viewed in FIG. 1.

Figure 3B:
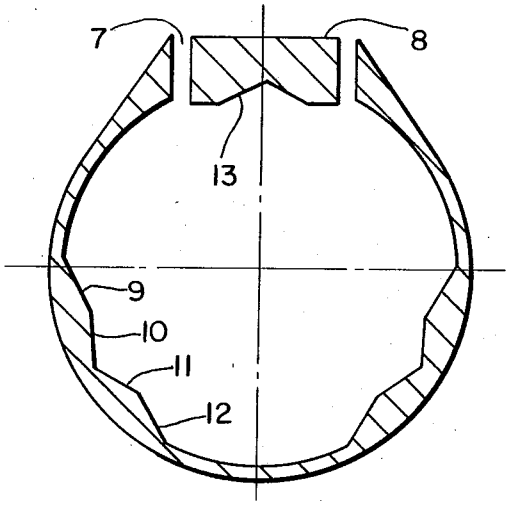
FIGS. 3*a*, 3*b* and 3*c* are transverse section views along line III—III of FIG. 2, illustrating 3 stages of relative motion between the closure sheath and the shaft of the writing tip.
Figure 3B:
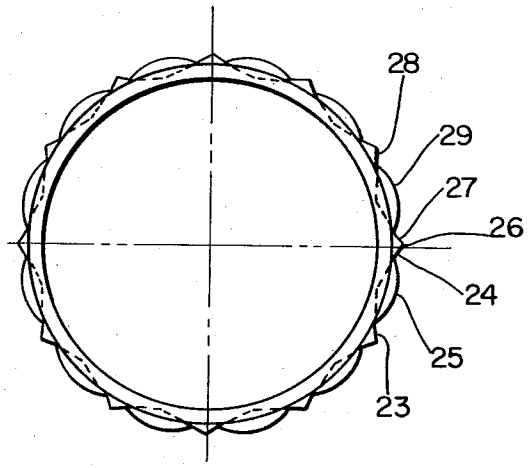
Figure 3B:
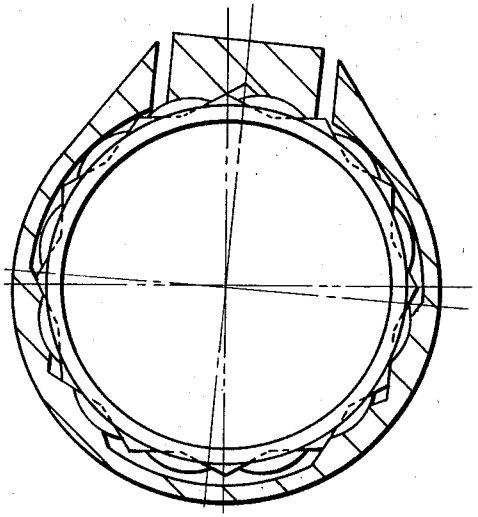
Figure 3C:
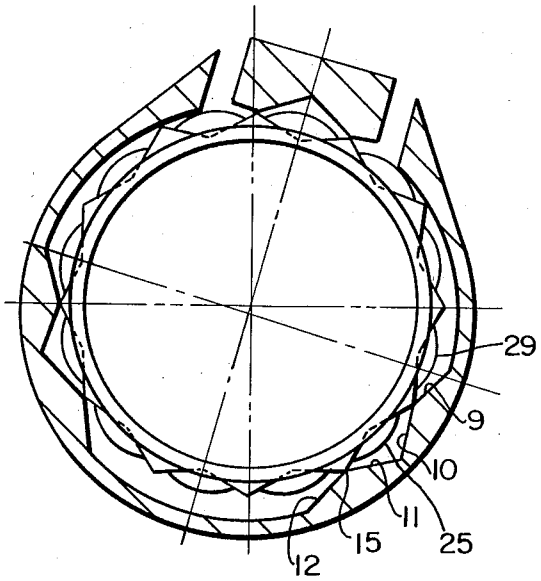
Figure 3A:
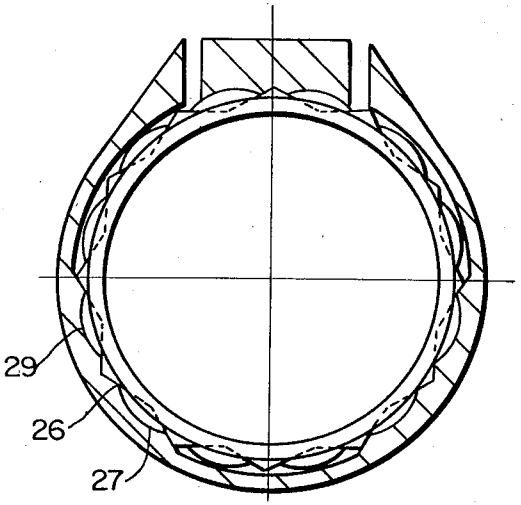

When it is intended that the closure cap be removed, a rotation of the closure cap and the writing tip 20 relative to one another must be effected, as shown in FIG. 3*b*. The cam faces of the sheath 1 thereby slide on the wedge faces of the writing tip 20, and a pivoting of the arm 8 radially outward takes place. This sliding of the cam faces along the wedge faces must be continued to the degree shown in FIG. 3*c*, so that the radially inwardmost areas of the cam faces—for instance, the intersecting edge of the cam face 9 and cam face 10 (FIG. 2)—are located above the webs 25 and 29. In this position, the cam faces or the protrusions embodying them are moved radially farther outward than the height of the webs 25 and 29. In this position, the closure cap is shifted toward the left (FIG. 1) because of the elasticity of the ring seal 5 and the seal 4 and because of the action of the spring 16, and it can then be removed from the writing tip 20.

While a preferred embodiment of the invention has been shown and described, the invention is to be defined by the scope of the appended claims.

I claim:

1. A writing instrument having a removable closure cap sealingly closing the writing tip, said cap comprising an axially extending sheath 1 with an insertion side defined by an opening substantially circular and a radially, elastically deformable, substantially axially extending finger 8 with a free end having a protrusion proximate its insertion side, so that when the closure cap is in the mounted position the protrusion is adapted to engage an indentation surrounding the writing instrument body and proximate the writing tip end, whereupon an annular shoulder of the writing tip normally located within the closure cap will be resiliently urged in sealing engagement with a sealing shoulder of the closure cap, characterized further in that said finger 8 is defined between two closely spaced, substantially axially extending notches 7 within the sheath, and an inner face of the finger (8), which is oriented toward said indentation when the closure cap (1, 2, 3, 4, 5) is in the mounted position, comprises a pair of planar cam faces (13), said cam faces being located normally substantially in intersecting chord planes of the circle defining the closure cap opening, which cam faces, upon a rotation of the mounted closure cap, being adapted to be brought into and out of engagement with at least one correspondingly-shaped wedge faces (27) on the writing tip body (20) as a result of the further face that at least a second group of at least two intersecting chord plane cam faces are defined within an inner face of said sheath at the same axial location as said cam faces 13, and a relative rotation of the sheath and instrument body causes said second group to be brought into and out of engagement with at least one other of correspondingly shaped wedge faces (27), whereby said second engagement radially deforms said finger 8 and releases said protrusion from said indentation, while displacing the longitudinal axes of said closure cap and said writing instrument.

2. A writing instrument as defined by claim 1, characterized in that on wedge faces (23, 24, 27 and 28) of the writing tip body have oppositely directed inclinations which are distributed over the entire circumference of the writing tip.

3. A writing instrument as defined by claim 2, characterized in that the oppositely inclined wedge faces (23, 24, 27 and 28) intersect with one another, defining tips (26) of the wedge faces which protrude beyond connecting areas between wedge faces inclined in opposite direction, said connecting areas being proximate the wedge face, at the end area located closer to the front end of the writing tip.

4. A writing instrument as defined by claim 3, characterized in that an area (14 and 15) proximate the intersection of each cam face (9, 10, 11 and 12) oriented toward the insertion side of the closure cap assembly (1, 2, 3, 4 and 5) is inclined toward the longitudinal axis, and extends radially inward from the insertion side toward the closure cap inner end and an area proximate the intersection of each wedge face, oriented toward the front end of the writing tip, is inclined toward the longitudinal axis, and extends radially outward from the writing tip body front end towards its rear end.

5. A writing instrument as defined by claim 2, characterized in that an area (14 and 15) proximate the intersection of each cam face (9, 10, 11 and 12) oriented toward the insertion side of the closure cap assembly (1, 2, 3, 4 and 5) is inclined toward the longitudinal axis, and extends radially inward from the insertion side toward the closure cap inner end, and an area proximate the intersection of each wedge face, oriented toward the front end of the writing tip, is inclined toward the longitudinal axis, and extends radially outward from the writing tip body front end towards its rear end.

6. A writing instrument as defined by claim 1, characterized in that the oppositely inclined wedge faces (23, 24, 27 and 28) intersect with one another, defining tips (26) of the wedge faces which protrude beyond connecting areas between wedge faces inclined in opposite direction, said connecting areas being proximate the wedge face, at the end area located closer to the front end of the writing tip.

7. A writing instrument as defined by claim 6, characterized in that an area (14 and 15) proximate the intersection of each cam face (9, 10, 11 and 12) oriented toward the insertion side of the closure cap assembly (1, 2, 3, 4 and 5) is inclined toward the longitudinal axis, and extends radially inward from the insertion side toward the closure cap inner end, and an area proximate the intersection of each wedge face, oriented toward the front end of the writing tip, is inclined toward the longitudinal axis, and extends radially outward from the writing tip body front end towards its rear end.

8. A writing instrument as defined by claim 1, characterized in that an area (14 and 15) proximate the intersection of each cam face (9, 10, 11 and 12) oriented toward the insertion side of the closure cap assembly (1, 2, 3, 4 and 5) is inclined toward the longitudinal axis, and extends radially inward from the insertion side toward the closure cap inner end.

9. A writing instrument as defined by claim 1, characterized in that an area proximate the intersection of each wedge face, oriented toward the front end of the writing tip, is inclined toward the longitudinal axis, and extends radially outward from the writing tip body front end towards its rear end.

* * * * *